US006129228A

United States Patent [19]

Adams et al.

[11] Patent Number: 6,129,228

[45] Date of Patent: Oct. 10, 2000

[54] APPARATUS AND METHOD FOR TRANSPORTING FITMENT AND FITMENT THEREFOR

[75] Inventors: Brian M. Adams, Newark; Daniel Luch, Morgan Hill; Rodger A. Moody, Castro Valley, all of Calif.

[73] Assignee: Portola Packaging, Inc., San Jose, Calif.

[21] Appl. No.: 09/361,333

[22] Filed: Jul. 26, 1999

Related U.S. Application Data

[63] Continuation-in-part of application No. 09/055,089, Apr. 3, 1998, Pat. No. 5,957,312, which is a continuation-in-part of application No. 08/808,682, Feb. 28, 1997, Pat. No. 5,810,184, which is a continuation of application No. 08/380,832, Jan. 30, 1995, abandoned.

[51] Int. Cl.[7] ..... B65D 25/42

[52] U.S. Cl. ..... 215/45; 53/133.2; 53/319; 220/258; 220/269; 229/125.05; 229/125.15; 493/87

[58] Field of Search ..... 215/45; 493/87; 53/133.1, 133.2, 309, 319; 229/125.05, 125.15; 220/258, 269

[56] References Cited

U.S. PATENT DOCUMENTS

| | | | |
|---|---|---|---|
| 4,964,562 | 10/1990 | Gordon | 493/87 |
| 5,058,360 | 10/1991 | Yamazaki et al. | 53/133.2 |
| 5,125,886 | 6/1992 | Dirksing | 493/87 |
| 5,133,486 | 7/1992 | Moore et al. | 229/125.05 |
| 5,176,300 | 1/1993 | Kishikawa et al. | 493/87 |
| 5,267,934 | 12/1993 | Pape et al. | 493/87 |
| 5,272,855 | 12/1993 | Togi et al. | 53/410 |
| 5,366,433 | 11/1994 | McCormick | 493/38 |
| 5,435,803 | 7/1995 | Owen et al. | 493/87 |
| 5,484,374 | 1/1996 | Bachner et al. | 493/87 |
| 5,597,082 | 1/1997 | Luch et al. | 229/125.15 |
| 5,601,669 | 2/1997 | Moody et al. | 493/87 |

FOREIGN PATENT DOCUMENTS

| | | |
|---|---|---|
| 0620152 | 10/1994 | European Pat. Off. . |
| 2645503 | 10/1990 | France . |
| 2238287 | 5/1991 | United Kingdom . |

*Primary Examiner*—Stephen P. Garbe

*Attorney, Agent, or Firm*—Flehr Hohbach Test Albritton & Herbert LLP

[57] ABSTRACT

A fitment for use as a pour spout for a paper carton or flexible bag for liquids and powders has a flange which may be welded around a hole in the carton or bag. A spout projecting outward from the flange is provided with a removable membrane integral with the interior of the spout. Preferably the membrane is concave. A horizontally disposed pull ring may be attached to the membrane by a connector so that pulling the ring removes the membrane by fracturing the tear line at the juncture of the outer edge of the membrane and the projection. A cap snaps over the spout and may be removed by unscrewing the complementary threads on cap and spout. Optionally, a tamper-evidencing band frangibly connected to the lower edge of the cap skirt engages the exterior of the spout so that the cap cannot be removed without breaking the frangible connection. Various means and methods for detachably securing the fitment to a spud or holder during delivery of the fitment from a chute to the interior of a carton are disclosed.

15 Claims, 10 Drawing Sheets

APPARATUS AND METHOD FOR TRANSPORTING FITMENT AND FITMENT THEREFOR

CROSS REFERENCE TO RELATED APPLICATIONS

This application is a continuation in part of U.S. Ser. No. 09/055,089, filed Apr. 3, 1998, now U.S. Pat. No. 5,957,312, which was a continuation-in-part of co-pending application, U.S. Ser. No. 08/808,682, filed Feb. 28, 1997, now U.S. Pat. No. 5,810,184, which was a continuation of application Ser. No. 08/380,832, filed Jan. 30, 1995, now abandoned.

BACKGROUND OF THE INVENTION

1. Field of the Invention

This invention relates to a new and improved combination of a fitment and a holder or spud which transports the fitment from a loading station to a welding station and to the method of operation thereof. More particularly, the invention relates to transporting a fitment which fits around a hole in a panel of a paperboard carton or other container, used for packaging liquids and powders into position for attaching the fitment to the container.

2. Description of Related Art

Fitments having removable membranes are shown in such patents as U.S. Pat. No. 5,303,838, issued Apr. 19, 1994, and particularly FIGS. 14–16 thereof. Fitments have become widely used on cartons and plastic pouches to facilitate dispensing the contents. In general these fitments comprise a cylindrical spout and a closure. Suitable means is provided to attach the spout to the carton or pouch. Other patents showing membranes are U.S. Pat. No. 3,458,080, issued Jul. 29, 1969, U.S. Pat. No. 4,380,303, issued Apr. 19, 1983, U.S. Pat. No. 5,133,486 issued Jul. 28, 1992 and others.

Some of the above and other fitments are moved from a chute or other source to the interior of a carton by a spud or holder to which the fitment is attached by vacuum. The present invention eliminates the use of vacuum and the mechanical problems inherent therein.

Some of the above and other fitments are moved from a chute or other source by a spud or holder received inside the fitment spout. The present invention relieves the build-up of pressure in the spout when the holder is inserted or creation of the vacuum when the holder is withdrawn. This makes the operation of transporting the fitment more rapid and trouble-free. It also eliminates possible fracture of the fitment membrane, if present.

SUMMARY OF THE INVENTION

The fitment of the present invention comprises a spout portion having a peripheral flange which may be welded or otherwise attached to a panel of a paperboard carton or to a flexible plastic container. A spout projects upward from the flange and, in some embodiments, is externally threaded adjacent its upper end. In some modifications of the invention, positioned within the spout is an internal membrane which may be concave and is joined to the inner wall of the spout along a line of weakness. A pull tab, such as a ring, is connected to the membrane in such fashion that by pulling the pull tab the membrane is detached from the interior of the spout. The concave membrane facilitates the consumer gripping the ring and has certain advantages in molding the part.

The cap of the present invention has a skirt which may be internally threaded to engage threads of the spout. A lower portion of the cap may have a tamper-evidencing band, one form of which has a bead which snaps under a shoulder on the lower portion of the spout. The tear band may be connected to the upper portion of the skirt by frangible means so that the cap may not be removed without giving external evidence of tampering.

One of the optional features of the invention is the fact that the cap may be attached to the spout by pressing the cap downward relative to the spout, the mating threads on the spout and cap skirt slipping past each other and then engaging. The tamper-evident band has a bead which engages a shoulder on the spout so that the cap cannot be unscrewed without severing the bridges which connect the band to the skirt and giving evidence of tampering.

A particular object and advantage of the present invention is that the fitment is so constructed that, by means of a spud or holder of a mandrel, it may be moved from a chute or other storage location to the carton. In preferred embodiments the mandrel is moved to place the fitment inside the carton and maneuvered so that the spout fits through and extends outside a hole in a wall of the carton. In the prior art, the fitment has been held on the spud by vacuum. This method is undesirable in that a source of vacuum must be provided and, further, drawing the vacuum to a sufficient extent to hold the fitment on the stud is time consuming, as is release of the vacuum.

Another prior art teaching is a frictional fit of the holder inside the lower end of the fitment spout. The holder of the present invention is formed to relieve any pressure differential (as compared with ambient pressure) which may tend to occur when the holder is inserted or removed from the holder. Such a pressure differential may cause the fitment to become dislodged during transfer and also may tend to damage a membrane or fracture a line of weakness, if present.

One means for holding the fitment on the spud is to provide an internal bead near the bottom of the spout which frictionally engages the spud. In a modification of the present invention, such a bead is intermittent rather than continuous. In another version of the invention, vertical internal ribs are formed on the lower end of the spout to grip the spud. In other modifications the bead may be eliminated and the holder grips the spout interior by friction or snap fit.

In another modification of the invention, the membrane, if desired, may be positioned at or adjacent the lower end of the spout. A ring depending from the fitment engages the spud. Optionally, instead of a continuous ring, fingers may project below the flange engaging of the spud. Such fingers may be rectangular in cross section or hooked. In a further modification, the ring or fingers may engage a groove formed in the spud.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
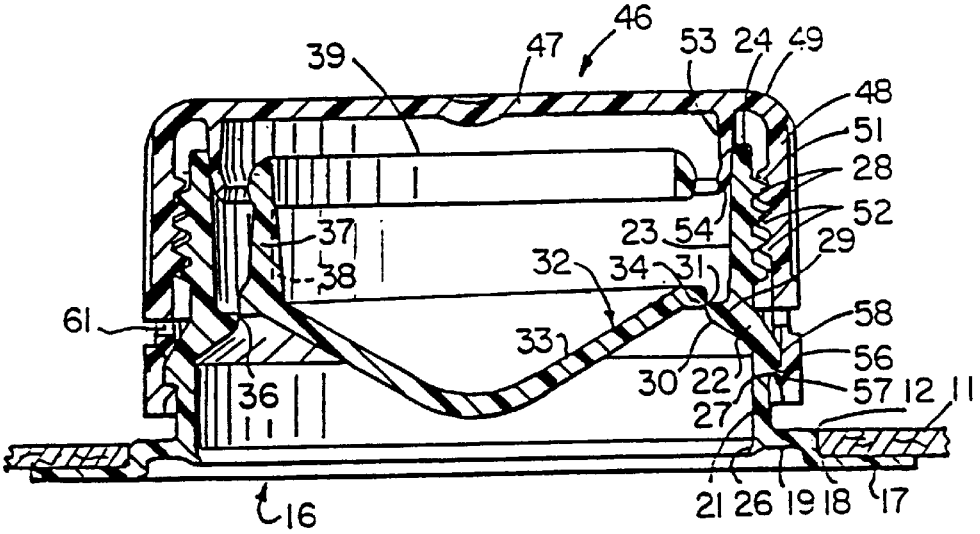
FIG. 1 is a vertical sectional view through the cap and one form of spout in assembled condition.

Referring to FIG. 1, one environment in which the present invention may be employed is by attachment to a carton panel 11 having a hole 12 therein. Fitment 16 is provided with a flange 17 which is welded or otherwise attached to the underside of panel 11 surrounding hole 12. Projecting up from the inner edge of flange 17 there may be a step 18 having an outside dimension to fit within the hole 12 and having a height approximately equal to the thickness of panel 11. Above step 18, the fitment has an inward extending portion 19. Extending upward from the inner edge of portion 19 is lower spout stretch 21 and thereabove is an upward-inward extending slanted stretch 22 which merges into a vertically extending upper stretch 23 terminating in a top edge 24. The inner and outer surfaces of the spout may be termed the "inner wall surface" and "outer wall surface", respectively.

Formed on the inside of the lower portion of lower spout stretch 21 is an inward-downward slanted bead 26 having a purpose which hereinafter appears. Use of this bead is optional.

An external shoulder 27 is formed at the juncture of lower spout stretch 21 and slanted stretch 22 for the purpose of attachment to the tamper-evidencing band of the cap as hereinafter explained. On the interior of the spout at approximately the juncture of the slanted stretch 22 and the upper stretch 23 is an inward projection 29 having an upper inner corner or edge 31. The underside of projection 29 and its juncture with lower spout stretch 21 is a curved surface 30 which facilitates dispensing the contents of the container. Projection 29 is positioned upward from the bottom of the spout. On the exterior of upper spout stretch 23 are external threads 28, here shown as eight in number, of an arcuate length of approximately 270°.

Figure 1A:
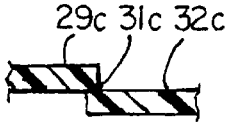
FIG. 1A is a fragmentary view of a modification of a portion of FIG. 1.
Figure 1B:
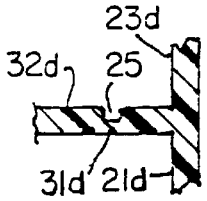
FIG. 1B is a fragmentary view of another modification of a portion of FIG. 1.
Figure 3:
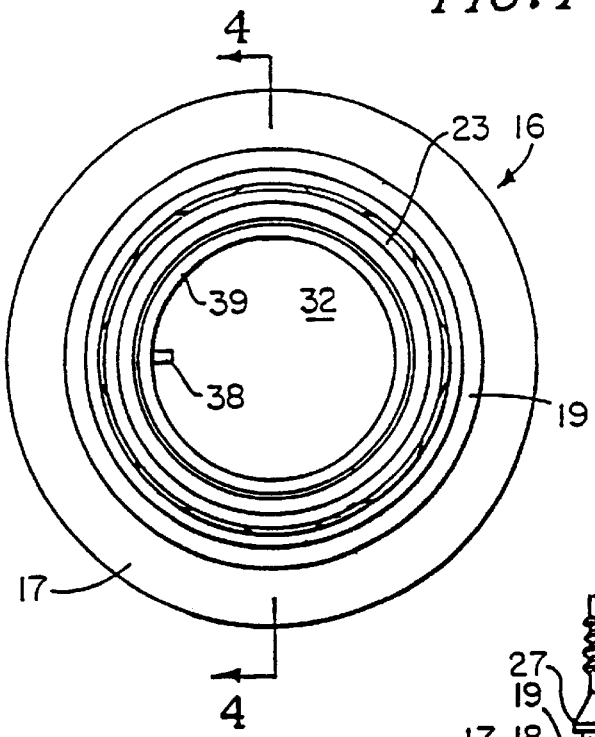
FIG. 3 is a top plan view of the spout of FIG. 1.
Figure 2:
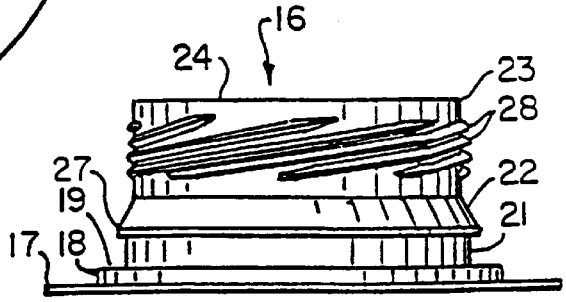
FIG. 2 is a side elevational view of the spout of FIG. 1.

Attached to the corner 31 is membrane 32 molded integrally with the fitment 16. The central portion of membrane 32 may be concave as shown by reference numeral 33. The lower outer edge 34 of membrane 32 joins the upper inner corner 31 of projection 29 and the connection therebetween is thin and constitutes a line of weakness or tear line 36. Reversal of the position of membrane 32*a* and projection 29*a* is shown in FIG. 1A. Other forms of scorelines such as thin section 25, as shown in FIG. 1B, are also usable. At one portion of member 32 is an upward connection or post 37 reinforced by thin vertical gusset 38 and connected to horizontal pull ring 39 which is located below the level of top edge 24. When the user grips ring 39 and pulls upward, the tear line 36 breaks and the membrane 32 may be removed. Alternatively, ring 39 may be attached to membrane 32 directly.

Cap 46 used with fitment 16 has a top 47 from which depends an upper skirt 48 joined to top 47 by a downwardly rounded corner 49. On the exterior of upper skirt 48 are vertical ribs 51 which assist the user in unscrewing the cap from the fitment. Upper skirt 48 is provided with internal threads 52 mating with the external threads 28 of fitment 16.

In the form of the invention shown in FIG. 1, a hollow plug 53 is formed on the underside of top 57, the lower outer corner thereof having a curved edge 54 which engages the inside of upper fitment 23 in a liquid tight seal.

Optionally, a tamper-evident band 56 is integrally attached to the bottom of upper skirt 48 by means of angularly-spaced frangible bridge connections 61, it being understood that the number and placement of such connections is subject to variation. Band 56 is provided with an internal bead 57 which snaps under shoulder 27 when the cap is applied to the fitment. To facilitate engagement of shoulder 27, an internal groove 58 is formed in band 56 immediately above internal bead 57.

Figure 5:
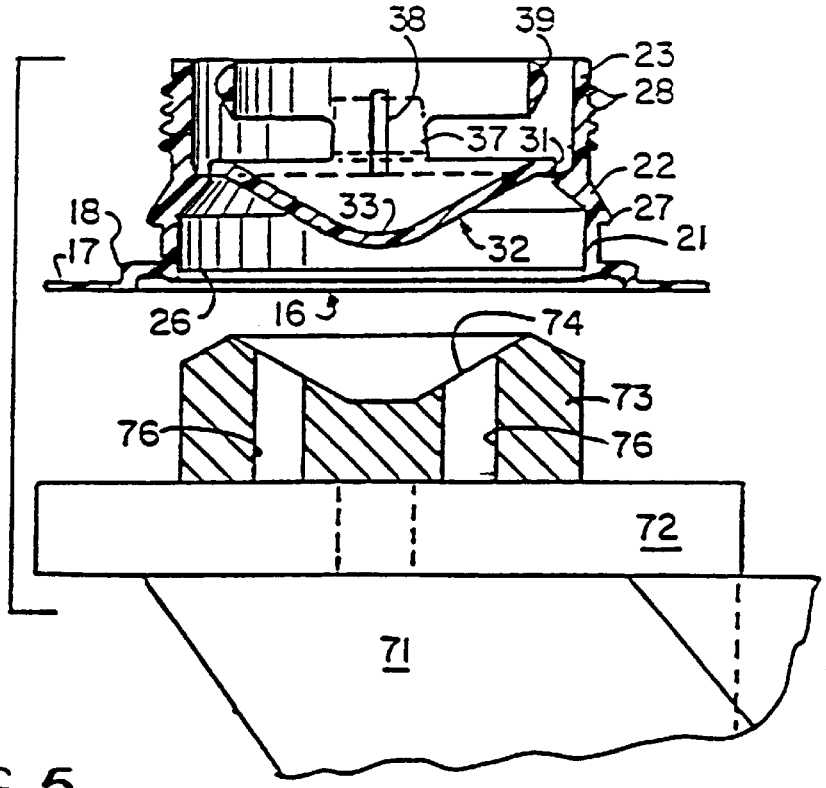
FIG. 5 is a schematic view showing how the fitment may be temporarily attached to the spud or holder of an anvil of a machine for inserting the fitment into a panel of a carton.

Directing attention to FIG. 5, automatic equipment for welding the fitment flange 17 to the underside of panel 11 is known in the art. In one form of such equipment an anvil or mandrel 71 has a flange 72 to which is attached a spud or fitment holder 73 which picks the fitment off of a chute (not shown) by fitting inside the lower spout stretch 21. The lowest portion of the concave area 33 of membrane 32 is above the upper edge of spud or fitment holder 73. In the form of the invention shown in FIG. 5, spud 73 has an external diameter such that when it is inserted through the lower end of the fitment 16 the inner bead 26 frictionally engages the exterior of spud 73. The spud is formed with a concavity 74 so as not to conflict with the concavity 33 of membrane 32.

Holes 76 in spud 73 relieve any pressure which may tend to build up inside lower spout stretch 12 when spud or fitment holder 73 is inserted therein. Holes 76 in spud 73 also relieve any vacuum which might tend to impede release of fitment 16 from spud 73 when the fitment has been positioned in the carton panel 11, as shown in FIG. 1.

Relieving such pressure or vacuum permits more rapid insertion or withdrawal of the spud 73. It also overcomes any tendency of the pressure or vacuum to fracture the line of weakness or tear line 36.

Figure 4:
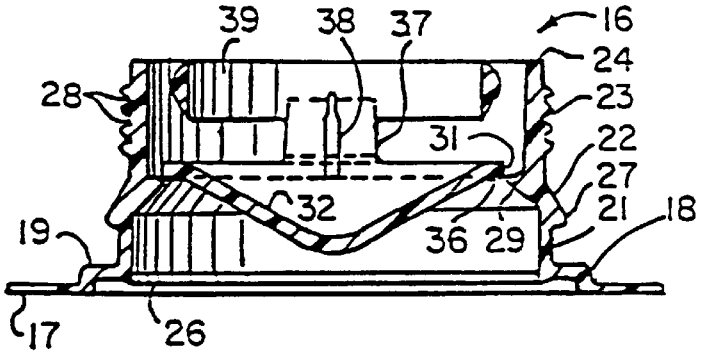
FIG. 4 is a vertical sectional view taken substantially along the line 4—4 of FIG. 3.
Figure 10:
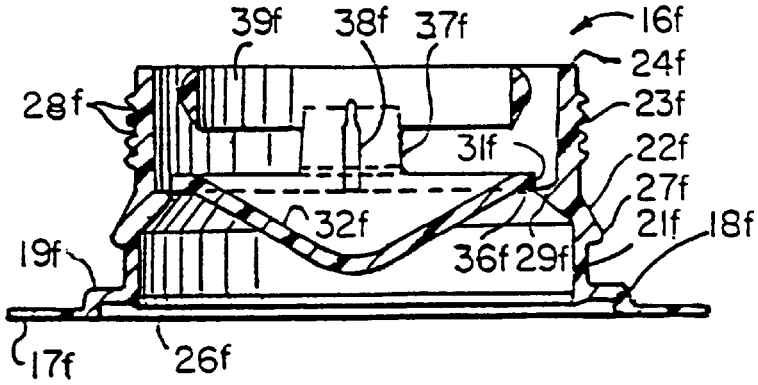
FIG. 10 is a view similar to FIG. 5 of a modification.

FIG. 10 of the drawings shows structure identical to that of FIG. 4 with the exception of that bead 26 shown in FIGS. 1–5 is eliminated. A spud such as spud 73 of FIG. 5 may engage the inside surface of lower spout stretch 21*f*.

Figure 11:
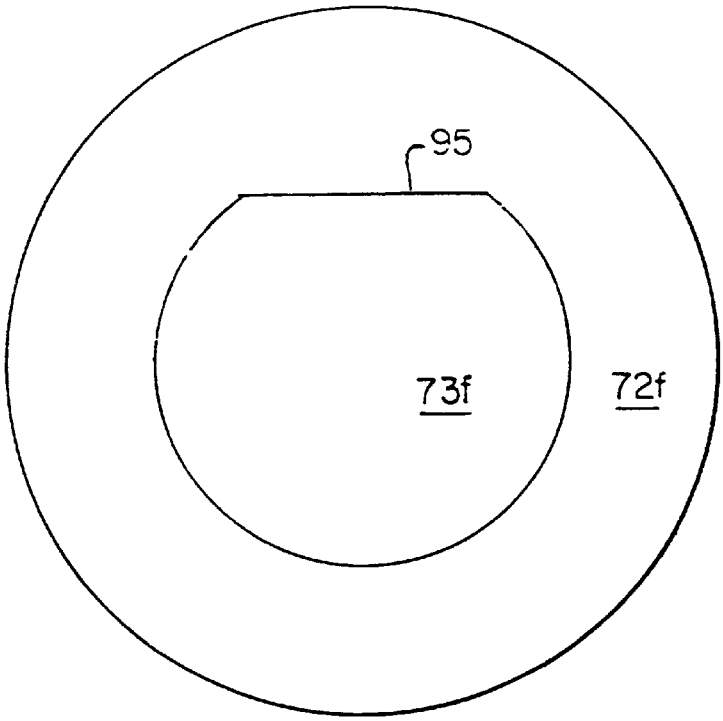
FIG. 11 is a plan view of a spud or holder used with any of the various fitments shown herein.

An alternative spud structure 73*f* is shown in FIG. 11. It will be understood that the spud of FIG. 11 may be used in any of the modifications of the fitment shown in the accompanying drawings and equivalents thereof. Instead of vent holes 76 being formed in spud 73, spud 73*f* is made non-cylindrical, as indicated by flat 95. It will be understood that other non-cylindrical forms of spuds may be used, for example, oval shapes, scalloped shapes, fluted shapes and others. The use of non-cylindrical shapes likewise relieves any pressure which may build up inside the lower spout stretch 21 and such shape likewise relieves any vacuum which may tend to impede withdrawal of the spud.

Figure 6:
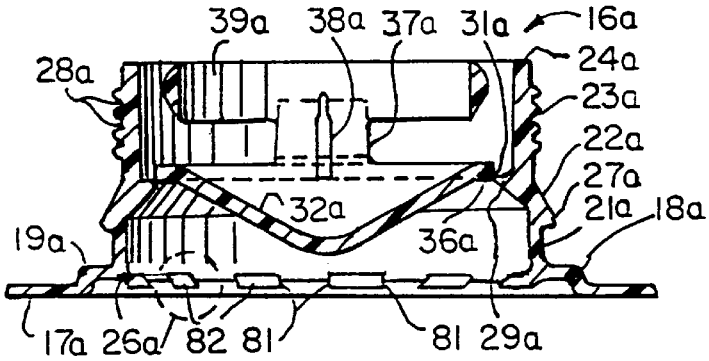
FIG. 6 is a view similar to FIG. 4 showing a modification.
Figure 6A:
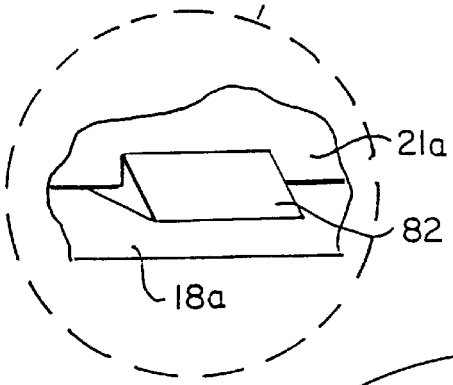
FIG. 6A is an enlarged fragmentary perspective view of a portion of FIG. 6.
Figure 7:
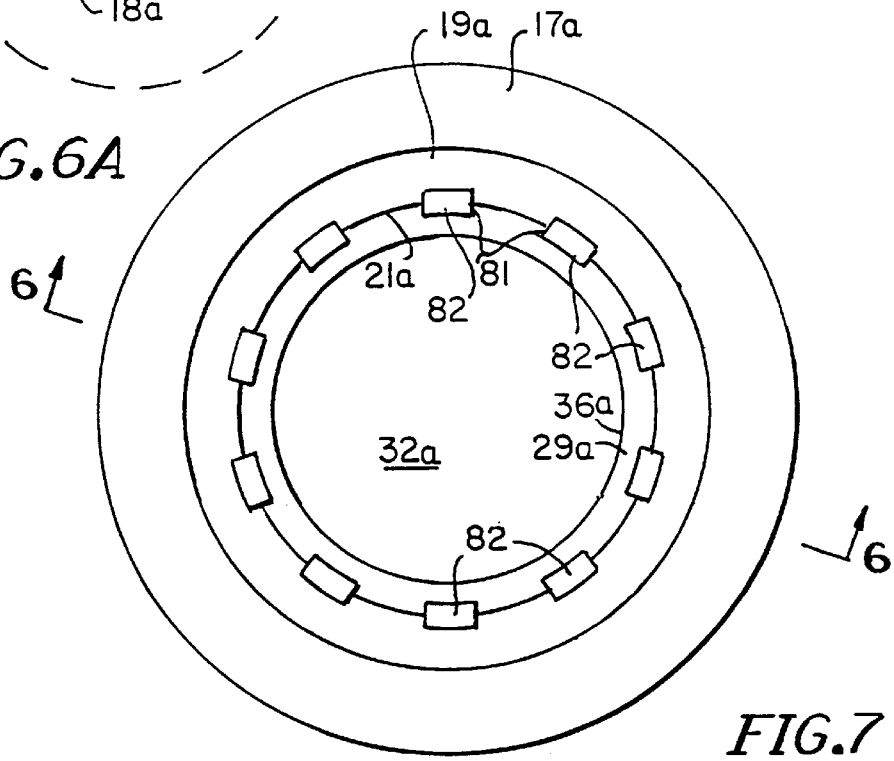
FIG. 7 is a bottom plan view of the structure of FIG. 6.

As shown in FIGS. 6 and 7, inner bead 26 need not be continuous. Bead 26*a* is interrupted, there being gaps 81 between segments 82. The number and placement of gaps 81 is subject to variation. The structure shown makes the bead 26*a* more flexible when engaging spud 76. Further the gaps 81 make it possible to pour out the contents of the carton more completely. As shown in FIG. 6A the upper surfaces of segments 82 slope downward-inward to facilitate engagement with spud or holder 73. The gaps 81 between segments 82 may function as vents to prevent build up of pressure or vacuum in the inside of the spout. Thus, the structure of the fitment may make the use of vented cylindrical or non-cylindrical spuds or fitment holders 73 or 73*f* unnecessary.

Figure 8:
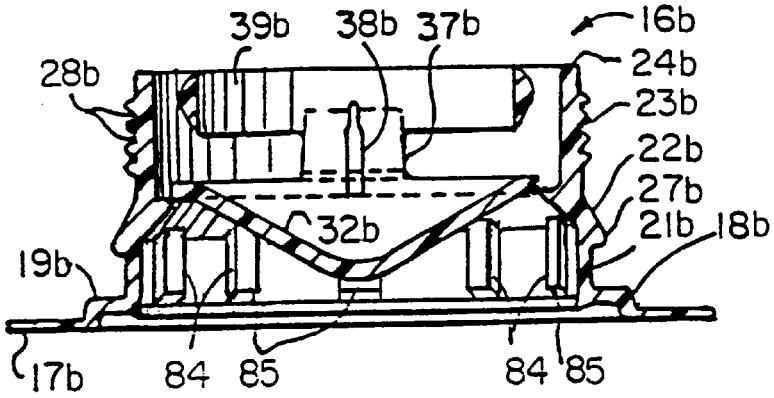
FIG. 8 is a view similar to FIG. 4 of a further modification.
Figure 9:
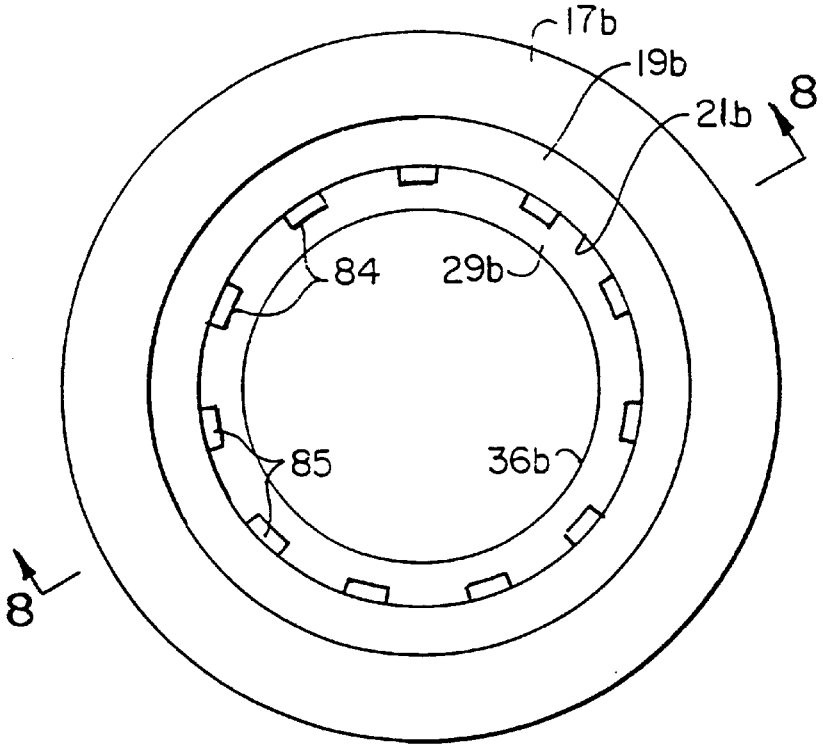
FIG. 9 is a bottom plan view of the structure of FIG. 8.

FIGS. 8 and 9 illustrate another construction wherein the bead 26 is eliminated. Vertical internal ribs 84 are formed extending upward from adjacent the bottom edge of lower spout stretch 21*b*. Such ribs 84 engage the exterior of spud or holder 73 to detachably secure the fitment 16*b* on the anvil 71. The number, width, thickness, and length of ribs 84 is subject to variation. Preferably the lower ends of ribs 84 are formed with downward-outward beveled surfaces 85 to facilitate the ribs 84 slipping over the spud. This form of fitment may be self-venting, making non-vented or cylindrical spuds usable.

Figure 12:
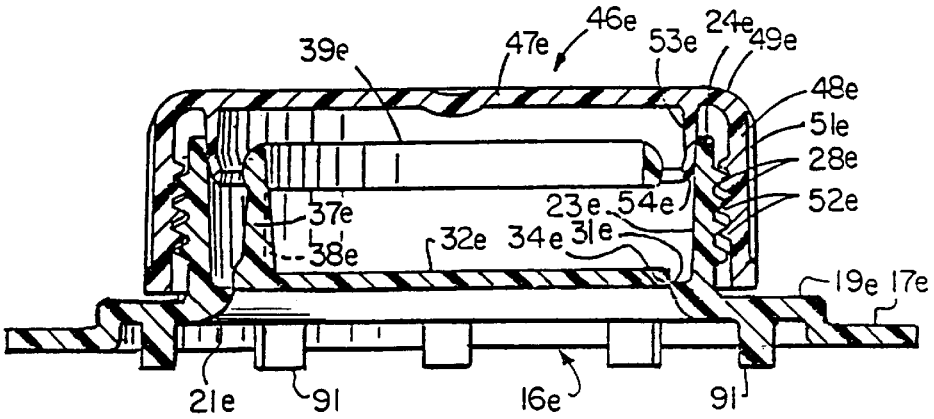
FIG. 12 is a view similar to FIG. 1 of another modification.
Figure 13:
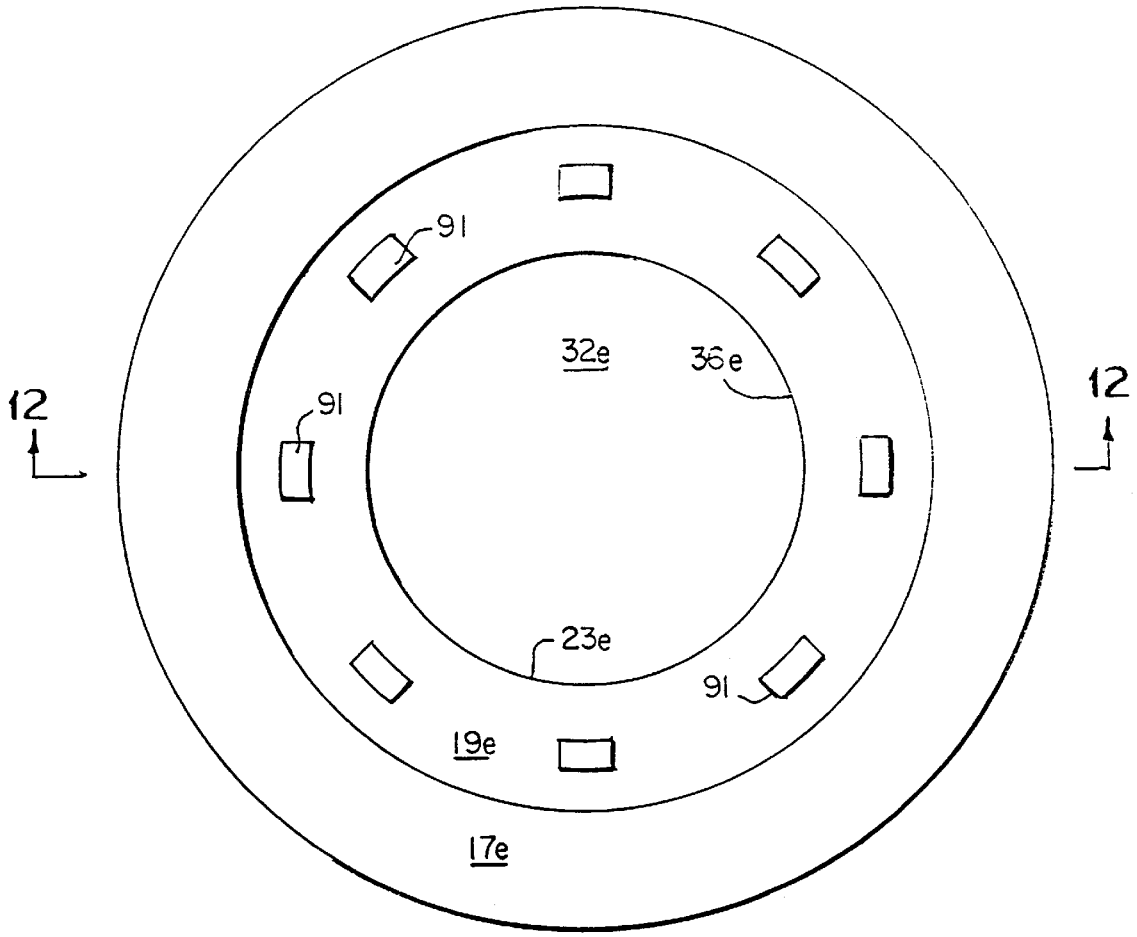
FIG. 13 is a bottom plan view of the modification of FIG. 12.
Figure 14:
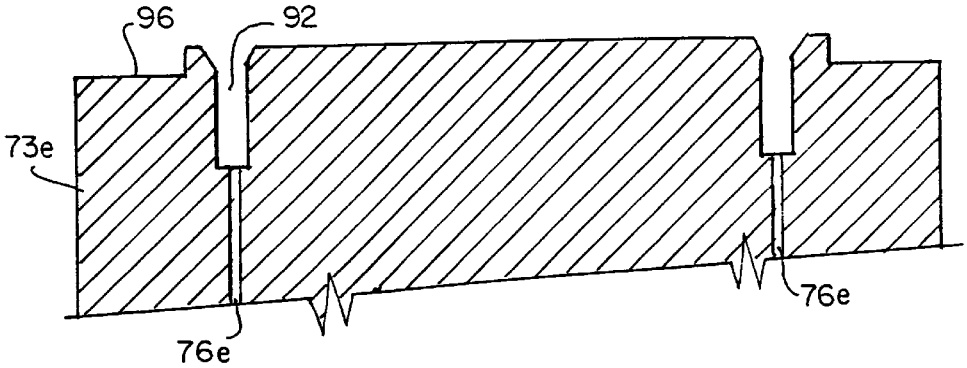
FIG. 14 is a fragmentary sectional view of a spud used with the modification of, for example, FIG. 15.

Directing attention to FIGS. 12–13, it will be seen that the membrane 32*e* may be located at the bottom edge of lower spout stretch 21*e* or at any desired location above said bottom edge. Attachment to spud 73 of anvil 71 shown in FIG. 14 is accomplished by means of downward extending fingers 91 on the lower surface or of inward extending portion 19*e*. The fingers 91 fit into groove 92 in spud 73*e* to detachably secure the fitment 16*e* thereon. Step 96 of spud 73*e* accommodates flange 17*e* being lower than portion 19*e*. The number of fingers 91, spacing therebetween and length thereof is subject to variation. It will be understood that fingers 91 might be formed on flange 17*e*. It is desirable that fingers 91 be used, rather than a continuous ring in order to facilitate dispensing all the contents of the container. Further, particularly if groove 92 is wider than the thickness of fingers 91, the vent holes 76*e* of FIG. 14 may be unnecessary.

Figure 15:
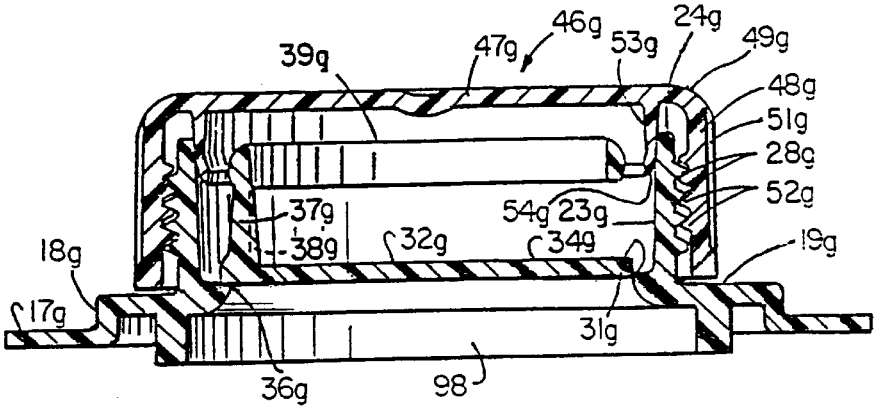
FIG. 15 is a view similar to FIG. 1 of a modification.
Figure 16:
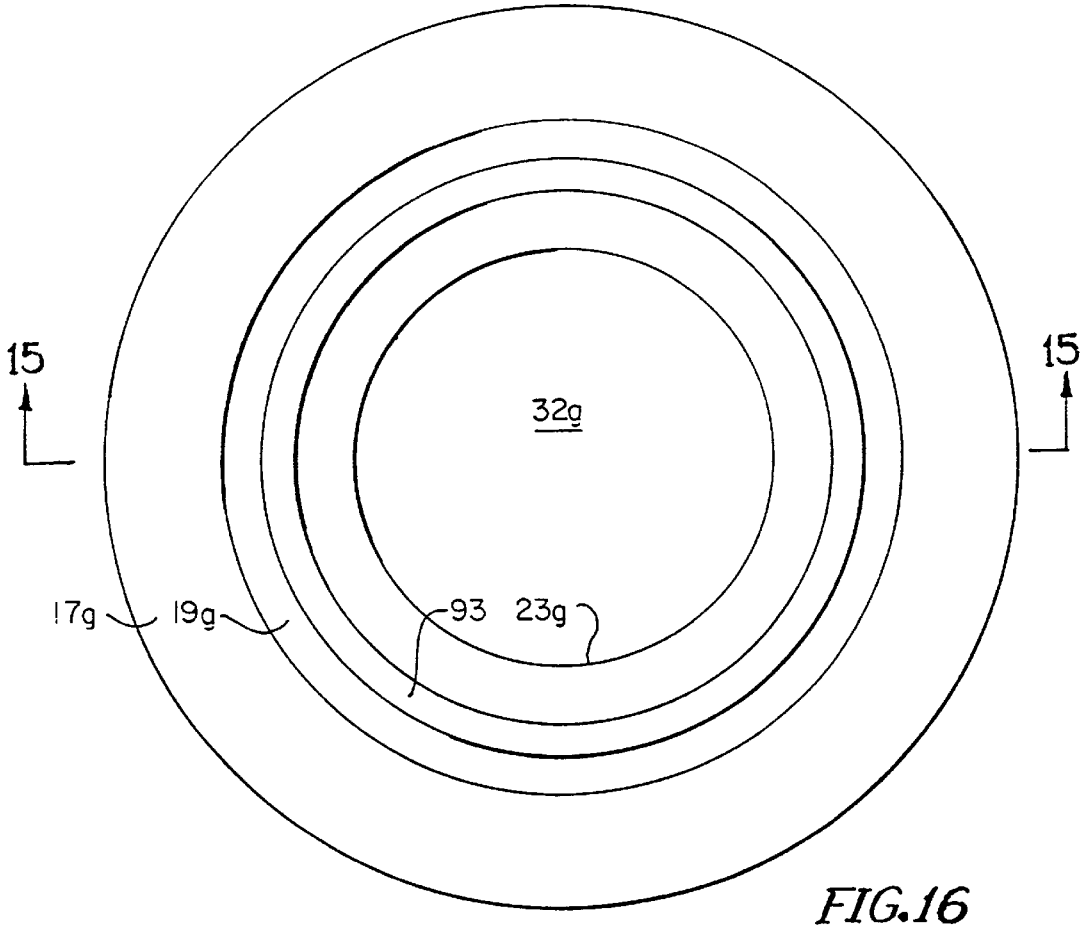
FIG. 16 is a bottom plan view of the modification of FIG. 15.

FIGS. 15–16 illustrate a modification of FIGS. 12–13 where the fingers 91 are replaced by a ring 93 which fits into the groove 92 of spud 73*e* of FIG. 14. Although shown as continuous, ring 93 may be formed with an opening (not shown) to facilitate complete dispensing of the contents of the container. Such opening may serve as a vent which makes a vented spud or non-cylindrical spud unnecessary.

Figure 17:
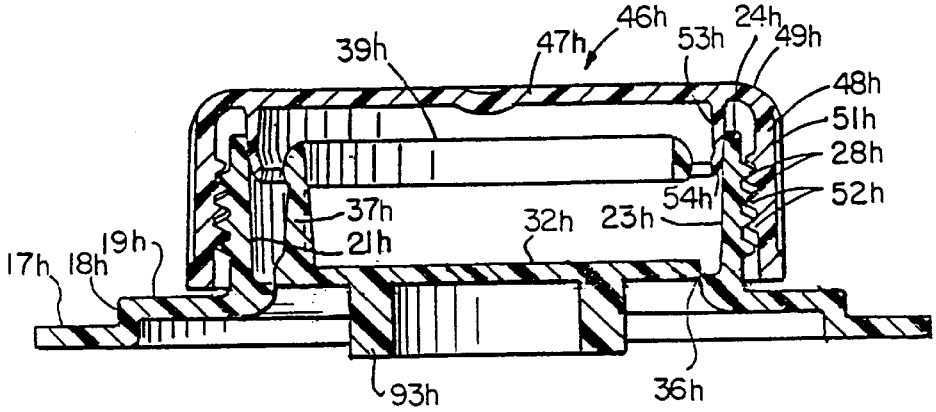
FIG. 17 is a view similar to FIG. 1 of a still further modification.

FIG. 17 is a view similar to FIG. 15 in which ring 93*h* depends from membrane 32*h*. It will be understood that the groove (not shown) in the spud (not shown) which engages ring 93*h* is suitably positioned and dimensioned for such purpose. It will further understood that the position of membrane 32*h* relative to the height of spout stretch 21*h* is also subject to variation. If ring 93*h* is formed with one or more openings, the openings may function as vents.

Figure 18:
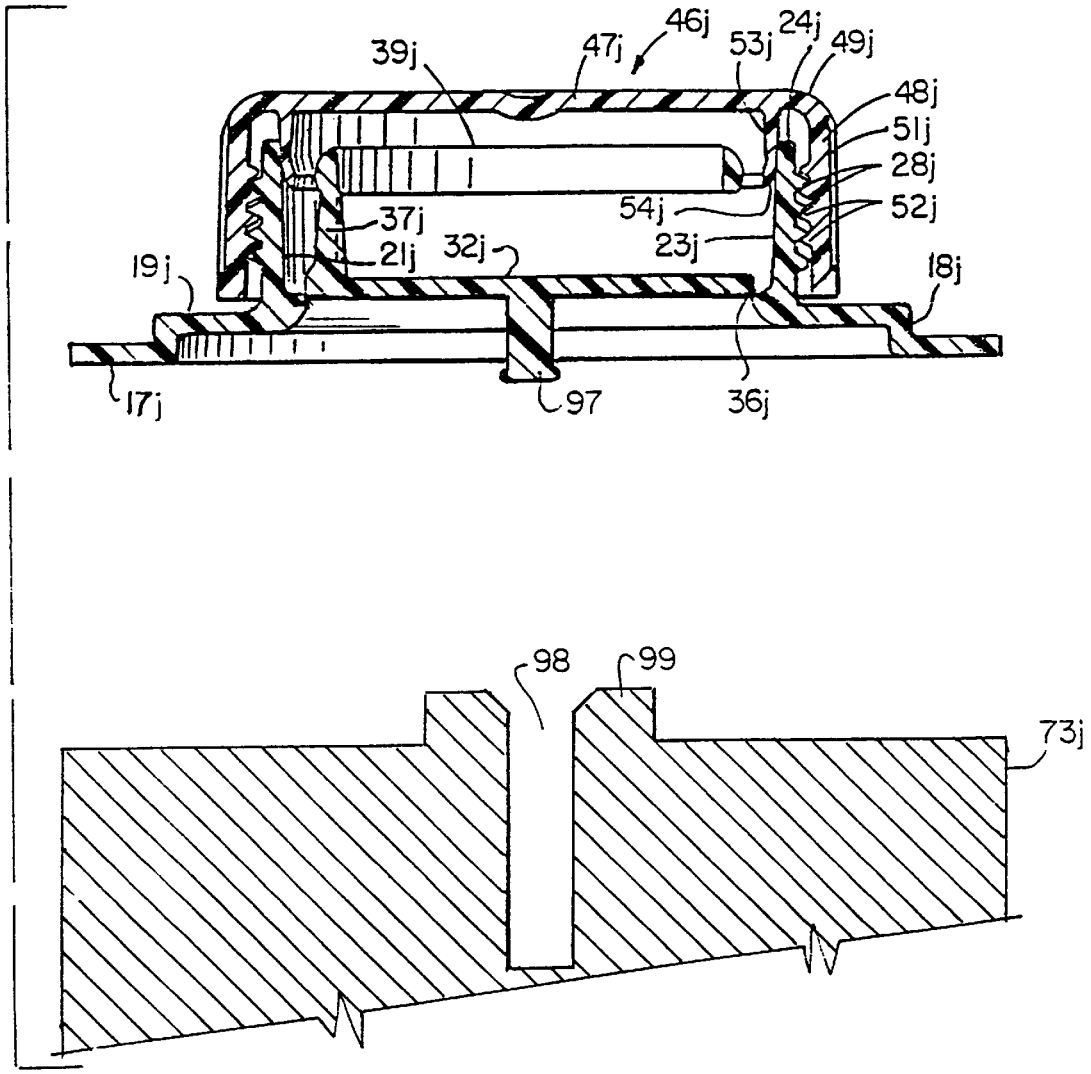
FIG. 18 is a view similar to FIG. 5 of a modification.

FIG. 18 shows a stud 97 depending from membrane 32*j*. Stud 97 is received in bore 98 formed in boss 99 in the upper surface of spud 73*j* or of a mandrel. Stud 97 frictionally engages bore 98 as the fitment is transported from a chute or other source to the carton. Bore 98 is shown formed with vent hole 76*j*.

Figure 19:
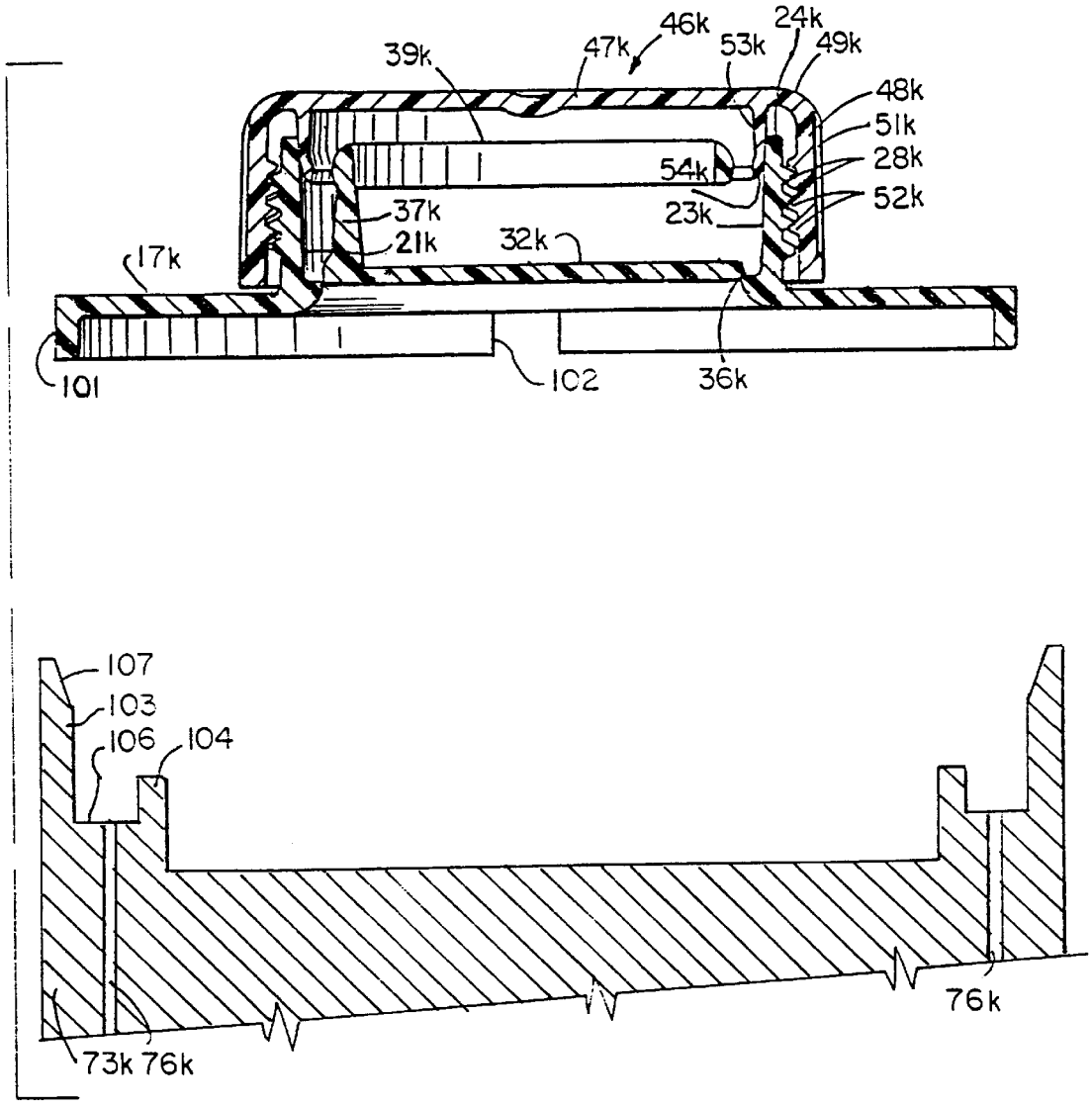
FIG. 19 is a view similar to FIG. 5 of another modification.

FIG. 19 illustrates a reinforcing ring 101 on or near the periphery of flange 17*k* which depends below flange 17*k*. Preferably openings 102 are formed at one or more locations around ring 101 to facilitate dispensing all the contents of the container and/or to function as vents. Spud 73*k* may be modified to engage ring 101. Thus an outer ring 106 of greater inside diameter than the outside diameter of ring 101 and preferably formed with an internal upward-outward taper 107 projects above spud 73*k* and engages the outside of ring 101. Inner ring 104 having an outside diameter less than that of the inside diameter of ring 101 also projects above spud or mandrel 73*k*. The walls of groove 106 between rings 103 and 104 frictionally engages ring 101. Vent holes 76*k* may be used, particularly if opening 102 does not satisfy this function.

In other respects, the modifications of FIGS. 1A, 1B, 6–7, 8–9, 10–11, 12–13, 14–16, 17, 18 and 19 resemble those of the preceding modifications and the same reference numerals followed by the subscripts c, d, a, b, f, e, g, h, j, and k, respectively, indicate corresponding parts.

For purpose of convenience, as used in the accompanying claims, "upper", "lower", "upward", "downward", "above", and "below" refer to the position of the fitment shown in the accompanying drawings. It will be understood that during manufacture, attachment and use, the parts may be positioned in other orientations.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a fitment holder having a fitment-engaging first portion and a fitment comprising, a spout flange, a spout projecting upward from said flange having an upper and a lower end and an inner and an outer wall surface, said spout having a fitment holder engaging second portion formed to detachably engage said first portion to prevent unintentional disengagement of said holder from said fitment, a membrane sealing off said spout having a line of weakness whereby said membrane may be detached from said spout, at least one of said first and second portions being shaped and dimensioned to relieve any differential from ambient pressure within said spout when said fitment holder is inserted into or withdrawn from said lower end.

2. The combination of claim 1 which said holder is formed with a vent extending through said holder to a top surface of said holder.

3. The combination of claim 1 which further comprises an internal bead on said inner wall surface, said bead detachably engaging said fitment-engaging first portion when said holder is inserted into said lower end.

4. The combination of claim 3 in which said bead is interrupted with gaps between segments of said bead.

5. The combination of claim 1 which further comprises internal ribs on said inner wall surface, said ribs detachably engaging said fitment-engaging first portion when said spud is inserted into said lower end.

6. The combination of claim 1 in which further comprises a member depending from said fitment, said fitment-engaging holder being formed with a groove to receive said member.

7. The combination of claim 6 in which said member is a ring.

8. The combination of claim 7 in which said ring depends from said flange.

9. The combination of claim 7 in which said ring depends from said membrane.

10. The combination of claim 7 in which said ring is interrupted.

11. The combination of claim 6 in which said member comprises a plurality of vertically disposed fingers.

12. The combination of claim 6 in which said member comprises a stud depending from said membrane.

13. The combination of claim 6 in which said member comprises a ring depending from the periphery of said flange.

14. The combination of claim 1 in which said first portion comprises a non-cylindrical spud.

15. The combination of claim 1 in which said fitment further comprises a pull tab disposed within said spout connected to and above said membrane, whereby upon pulling said pull tab said membrane is at least partially detached from said spout along said line of weakness, said membrane being spaced upward from said lower end a distance sufficient so that a fitment holder inserted in said lower end detachably engages said spout by fitting inside said lower end to prevent unintentional disengagement of said fitment holder from said fitment, said membrane being spaced below said upper end a sufficient distance for said pull tab to be positioned within said inner wall surface and below said upper end.

* * * * *